US011841662B2

(12) United States Patent
Nguyen et al.

(10) Patent No.: US 11,841,662 B2
(45) Date of Patent: Dec. 12, 2023

(54) SHEET CONVEYANCE UNIT AND IMAGE FORMING SYSTEM THEREWITH

(71) Applicant: KYOCERA Document Solutions Inc., Osaka (JP)

(72) Inventors: Hoang Viet Nguyen, Osaka (JP); Ha Thi Ngoc Do, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 18/176,559

(22) Filed: Mar. 1, 2023

(65) Prior Publication Data

US 2023/0280671 A1 Sep. 7, 2023

(30) Foreign Application Priority Data

Mar. 3, 2022 (JP) ..... 2022-032388

(51) Int. Cl.
*G03G 15/00* (2006.01)
*G03G 15/01* (2006.01)

(52) U.S. Cl.
CPC ..... *G03G 15/6502* (2013.01); *G03G 15/0105* (2013.01); *G03G 15/6511* (2013.01); *G03G 15/757* (2013.01); *G03G 2215/00354* (2013.01); *G03G 2215/00379* (2013.01); *G03G 2215/00383* (2013.01); *G03G 2215/00396* (2013.01); *G03G 2215/00679* (2013.01); *G03G 2215/04* (2013.01); *G03G 2221/1672* (2013.01)

(58) Field of Classification Search
CPC ..... G03G 15/0105; G03G 15/757; G03G 15/6502; G03G 15/6511; G03G 2215/00354; G03G 2215/00679; G03G 2215/04; G03G 2215/00379; G03G 2215/00383; G03G 2215/00396; G03G 2221/1672
See application file for complete search history.

(56) References Cited

U.S. PATENT DOCUMENTS

| | | | | |
|---|---|---|---|---|
| 9,878,861 | B1 * | 1/2018 | Ikeda | B65H 1/04 |
| 2020/0019113 | A1 * | 1/2020 | Uohashi | G03G 21/1695 |
| 2022/0082978 | A1 * | 3/2022 | Maeda | B65H 1/14 |

FOREIGN PATENT DOCUMENTS

JP 2017-187656 A 10/2017

* cited by examiner

*Primary Examiner* — Joseph S Wong
(74) *Attorney, Agent, or Firm* — Stein IP, LLC

(57) ABSTRACT

A sheet conveyance device includes a sheet passage, a first sheet stacker, a second sheet stacker, and a sheet feeder. The first sheet stacker has a bottom and a lift. The sheet feeder includes an opening and a feed roller. The sheet conveyance device includes an assist plate supported to be movable between a first and a second position and an urging member. With the first sheet stacker mounted in an apparatus body, the assist plate moves from the first to the second position against the urging force of the urging member to allow passage of a sheet from the first sheet stacker to the sheet feeder. With the first sheet stacker removed from the apparatus body, the assist plate is urged by the urging member to move from the second to the first position to support the sheet conveyed from the second sheet stacker to the sheet feeder.

5 Claims, 9 Drawing Sheets

SHEET CONVEYANCE UNIT AND IMAGE FORMING SYSTEM THEREWITH

INCORPORATION BY REFERENCE

This application is based on and claims the benefit of priority from Japanese Patent Application No. 2022-032388 filed on Mar. 3, 2022, the contents of which are hereby incorporated by reference.

BACKGROUND

The present disclosure relates to a sheet conveyance unit and an image forming system provided therewith.

There is conventionally known, as a sheet conveyance device for incorporation in an image forming apparatus that allows what is called hand-feed printing, one provided with two sheet stack sections (a first sheet stack section and a second sheet stack section). The first sheet stack section is removably mounted in the image forming apparatus. The second sheet stack section is provided on a side part of the image forming apparatus. In the first sheet stack section are stored sheets such as printing sheets and the like of various regular sizes. In the second sheet stack section are stored, in addition to printing sheets of regular sizes, printing sheets of non-regular sizes, OHP sheets, and envelopes. In hand-feed printing, sheets are fed from the second sheet stack section.

Such a sheet conveyance device includes, in addition to the two sheet stack sections mentioned above, a sheet conveyance passage and a sheet feed section. The sheet conveyance passage feeds sheets to an image forming section in the image forming apparatus. The sheet feed section feeds sheets from the two sheet stack sections to the sheet conveyance passage.

Here, the sheet feed section has a sheet feed roller and an opening. With the first sheet stack section mounted in the image forming apparatus, the sheet feed roller is located above the first sheet stack section. The opening is formed such that a sheet stacked in the first sheet stack section can pass through it. The first sheet stack section includes a bottom portion and a lift portion.

Sheets are stacked on the bottom portion. The lift portion is provided in the bottom portion so as to be ascendible-descendible so that it can raise and lower end parts of the sheets on the bottom portion (their downstream end parts with respect to the sheet conveyance direction). With the first sheet stack section mounted in the image forming apparatus, the lift portion faces the feed roller.

On such a sheet conveyance device, when a sheet is fed from the first sheet stack section to the sheet conveyance passage, the lift portion presses the sheet against the feed roller via the opening so that, as the feed roller rotates, the sheet is fed. When a sheet is fed from the second sheet stack section to the sheet conveyance passage, with the first sheet stack section mounted in the apparatus body, the sheet is conveyed from the second sheet stack section to between the lift portion and the feed roller. At this time, the sheet is pressed against the feed roller by the lift portion so that, as the feed roller rotates, the sheet is conveyed to the sheet conveyance passage.

Incidentally, a sheet conveyance device as described above can be mounted in the body of not only an image forming apparatus but also an apparatus provided with at least two sheet stack sections as sheet feed sources (such as a large-capacity sheet storage apparatus that is arranged upstream of an image forming apparatus and that can feed sheets to the image forming apparatus).

SUMMARY

According to one aspect of the present disclosure, a sheet conveyance device includes a sheet conveyance passage, a first sheet stack section, a second sheet stack section, and a sheet feed section. The sheet conveyance passage is provided in an apparatus body, and conveys a sheet. The first sheet stack section has a bottom portion on which the sheet is stacked, and a lift portion that is provided so as to be ascendible-descendible relative to the bottom portion and that raises and lowers a downstream end part, in the sheet conveyance direction, of the sheet on the bottom portion. The first sheet stack section is removably mounted in the apparatus body. On the second sheet stack section, the sheet conveyed along the sheet conveyance passage is stacked. The sheet feed section has an opening that is formed in the sheet conveyance passage and that permits the sheet stacked on the first sheet stack section to pass through it, and a feed roller that disposed at a position overlapping the opening with respect to the sheet conveyance direction. With the first sheet stack section mounted in the apparatus body, the lift portion presses the sheet against the feed roller via the opening, and the sheet feed section feeds the sheet pinched between the lift portion and the feed roller along the sheet conveyance passage. The sheet conveyance device further includes an assist plate that is supported so as to be movable between a first position in which the assist plate overlaps the opening with respect to the sheet conveyance direction to face the feed roller and a second position in which the assist plate is located away from the opening, and an urging member that urges the assist plate from the second position toward the first position. With the first sheet stack section mounted in the apparatus body, the assist plate moves from the first position to the second position against the urging force of the urging member to allow the sheet to pass from the first sheet stack section to the sheet feed section. With the first sheet stack section removed from the apparatus body, the assist plate is urged by the urging member to move from the second position to the first position to support the sheet conveyed from the second sheet stack section to the sheet feed section.

DETAILED DESCRIPTION

Figure 1:
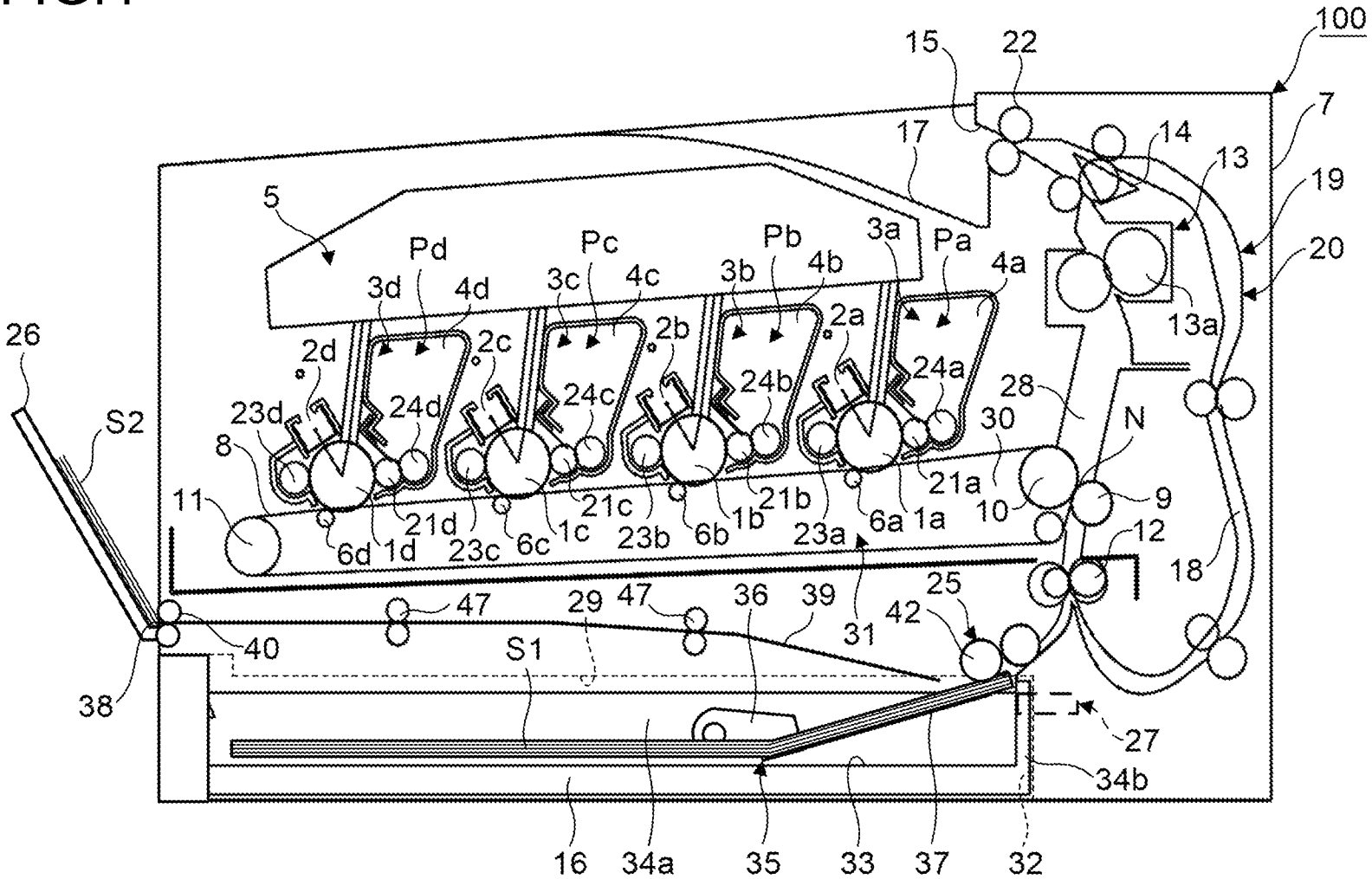
FIG. 1 is a schematic sectional view showing the internal construction of an image forming apparatus incorporating a sheet conveyance device according to a first embodiment of the present disclosure.

A first embodiment of the present disclosure will be described below with reference to the accompanying drawings. FIG. 1 is a schematic sectional view showing the internal construction of an image forming apparatus 100 incorporating a sheet conveyance device 19 according to the first embodiment of the present disclosure. The image forming apparatus 100 shown in FIG. 1 is what is called a tandem-type color printer.

Inside the body (hereinafter referred to as the apparatus body 7) of the image forming apparatus 100, image forming sections Pa to Pd are provided side by side in the horizontal direction. The image forming sections Pa to Pd sequentially form a magenta, a cyan, a yellow, and a black image respectively through the processes of electrostatic charting, exposure to light, image development, and image transfer. The image forming sections Pa to Pd are provided to correspond to the images of the different colors respectively. The following description focuses on the image forming section Pa, and for the image forming sections Pb to Pd, which are structured similarly to it, no separate description will be given.

The image forming section Pa includes a photosensitive drum 1*a* that carries a visible image (toner image). Above the image forming section Pa, an exposure device 5 is disposed. The exposure device 5 shines a light beam onto the surfaces of the photosensitive drums 1*a* to 1*d* to form electrostatic latent images. Around the photosensitive drum 1*a*, along the drum rotation direction (clockwise in FIG. 1), there are arranged a charging device 2*a*, a development device 3*a*, and a rubbing roller 23*a*.

The charging device 2*a* is disposed opposite the photosensitive drum 1*a*, and can electrostatically charge the surface of the photosensitive drum 1*a*. The development device 3*a* includes a developing container 4*a*, a developing roller 21*a*, and a feed roller 24*a*. The developing container 4*a* is loaded with a predetermined amount of toner. The developing containers 4*a* to 4*d* are charged with magenta, cyan, yellow, and black toner respectively to suit the development devices 3*a* to 3*d*. The developing roller 21*a* is disposed opposite the photosensitive drum 1*a*. The feed roller 24*a* feeds the toner in the developing container 4*a* to the outer circumferential surface of the developing roller 21*a*. The developing roller 21*a* can feed the toner fed to the outer circumferential surface over to the photosensitive drum 1*a*.

Below the photosensitive drums 1*a* to 1*d*, an intermediate transfer unit 31 is provided. The intermediate transfer unit 31 includes a frame 30, a driving roller 10, a tension roller 11, an intermediate transfer belt 8, and primary transfer rollers 6*a* to 6*d*.

The frame 30 extends in the width direction of the image forming apparatus 100 (the left-right direction in FIG. 1). The driving roller 10 and the tension roller 11 are rotatably supported at the opposite ends of the frame 30 in its longitudinal direction.

The intermediate transfer belt 8 is an endless belt (preferably, a seamless belt with no seams). The intermediate transfer belt 8 is stretched from the tension roller 11 to the image forming apparatus 100 so as to be rotatable in the circumferential direction.

The driving roller 10 is connected to a belt driving motor (not illustrated). As the driving roller 10 rotates with the rotary driving force of the belt driving motor, by a friction force, the rotary driving force is transmitted to the intermediate transfer belt 8. As a result, the intermediate transfer belt 8 rotates in the same direction as the rotation direction of the driving roller 10.

The primary transfer rollers 6*a* to 6*d* are supported on the frame 30 so as to be rotatable and movable relative to it, at positions opposite the photosensitive drums 1*a* to 1*d* across the intermediate transfer belt 8.

A secondary transfer roller 9 is provided opposite the driving roller 10 across the intermediate transfer belt 8. The secondary transfer roller 9 is kept in pressed contact with the intermediate transfer belt 8 to form a secondary transfer nip N. The secondary transfer roller 9 transfers the toner images formed on the intermediate transfer belt 8 to a sheet S1 or S2 that passes through the secondary transfer nip N.

Inside the image forming apparatus 100, to the side of the image forming sections Pa to Pd and the intermediate transfer belt 8, the sheet conveyance device 19 is provided. The sheet conveyance device 19 includes a sheet conveyance passage 20, a pair of registration rollers 12, a sheet cassette 16 (first sheet stack section), a sheet feed section 25, an MPF (multi paper feeder) tray 26 (second sheet stack section), an assist plate 27, and an urging member 54 (see FIG. 2).

The sheet conveyance passage 20 includes a main conveyance passage 28 and a duplex conveyance passage 18. The main conveyance passage 28 extends in the up-down direction. Midway along the main conveyance passage 28 are disposed the pair of registration rollers 12, the secondary transfer roller 9, and a fixing device 13. The main conveyance passage 28 conveys a sheet S1 or S2 from the MPF tray 26 or the sheet cassette 16, which will be described later, such that the sheet passes through the pair of registration rollers 12, the secondary transfer nip N, and the fixing device 13 in this order.

The pair of registration rollers 12 aligns the conveyance direction of the sheet S1 or S2 such that its leading end (a downstream end part of it with respect to the sheet conveyance direction) is orthogonal to the sheet conveyance direction, and thereby corrects slanted conveyance (skew).

In a downstream end part of the main conveyance passage 28 with respect to the sheet conveyance direction, a sheet discharge port 15 is provided that leads to outside the image forming apparatus 100. The sheet discharge port 15 is provided with a pair of discharge rollers 22.

Between the pair of discharge rollers 22 and the fixing device 13 with respect to the sheet conveyance direction, a branch portion 14 is provided. The duplex conveyance passage 18 branches off the main conveyance passage 28 at a position where it overlaps the branch portion 14 of the main conveyance passage 28 with respect to the sheet conveyance direction, and re-joins the main conveyance passage 28 at a position upstream of the pair of registration rollers 12. The branch portion 14 can distribute the sheet S1 or S2 having passed through the fixing device 13 to the sheet discharge port 15 or to the duplex conveyance passage 18.

The sheet cassette 16 and the MPF tray 26 are provided upstream of the main conveyance passage 28 with respect to the sheet conveyance direction. Sheet S1 can be stacked on the sheet cassette 16, and sheets S2 can be stacked on the MPF tray 26. The sheet feed section 25 is disposed between, at one side, the main conveyance passage 28 and, at the other side, the sheet cassette 16 and the MPF tray 26, and feeds a sheet S1 or S2 to the main conveyance passage 28. The feeding of the sheet S1 or S2 will be described in detail later.

Next, a description will be given of an image forming procedure on the image forming apparatus 100. When an instruction to start image formation is entered by a user, first, while the photosensitive drum 1*a* is rotated, the charging devices 2*a* to 2*d* electrostatically charge the surfaces of the photosensitive drums 1*a* to 1*d* uniformly. Next, the exposure device 5 shines light onto the surfaces of the photosensitive drums 1*a* to 1*d* so that electrostatic latent images according to an image signal are formed on the photosensitive drums 1*a* to 1*d*.

Subsequently, the toner in the development devices 3*a* and 3*d* is fed to the photosensitive drums 1*a* to 1*d* by the developing rollers 21*a* to 21*d* and electrostatically attach to them. Thus, toner images according to the electrostatic latent images are formed on the photosensitive drums 1*a* to 1*d*.

Now, the driving roller 10 is rotated so that the intermediate transfer belt 8 starts to rotated counter-clockwise. The toner images of the different colors formed on the photosensitive drums 1*a* to 1*d* are then primarily transferred, one after the next, to the intermediate transfer belt 8.

Thereafter, with predetermined timing, a sheet S1 or S2 is fed from the sheet cassette 16 or the MPF tray 26 to the main conveyance passage 28, passes through the pair of registration rollers 12, and is conveyed to the secondary transfer nip N. The toner images on the intermediate transfer belt 8 are then secondarily transferred to the sheet S1 or S2. The sheet S1 or S2 is then conveyed to the fixing device 13, where it is heated and pressed by a pair of fixing rollers 13*a* in the fixing device 13 so that the toner images are fixed to the surface of the sheet S1 or S2.

Here, in a case where the sheet S1 or S2 is subjected to simplex printing, the branch portion 14 distributes the sheet S1 or S2 having passed through the fixing device 13 to the sheet discharge port 15. The sheet S1 or S2 having reached the sheet discharge port 15 is discharged onto a sheet discharge tray 17 by the pair of discharge rollers 22.

When the sheet S1 or S2 is subjected to duplex printing, the branch portion 14 distributes the sheet S1 or S2 having passed through the fixing device 13 to the duplex conveyance passage 18. The duplex conveyance passage 18 conveys the sheet S1 or S2, while reversing it top side down, once again to the pair of registration rollers 12. The sheet S1 or S2 passes through the secondary transfer nip N and the fixing device 13 so that toner images are fixed to its reverse side, and is then distributed to the sheet discharge port 15 by the branch portion 14.

Figure 2:
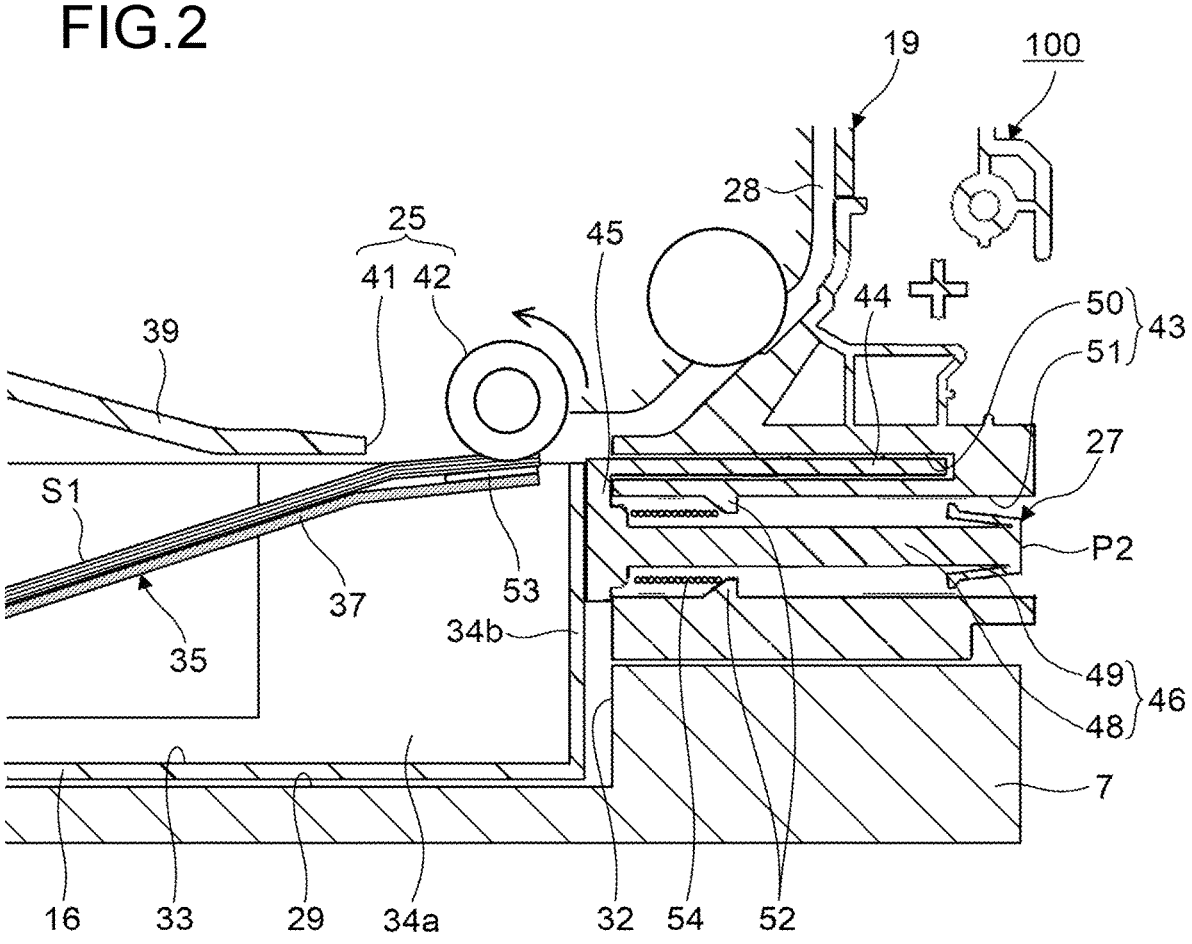
FIG. 2 is a side sectional view, on an enlarged scale, around a lower part of an apparatus body.

Next, the feeding of the sheet S1 or S2 will be described in detail. FIG. 2 is a side sectional view, on an enlarged scale, around a lower part of the apparatus body 7. As shown in FIGS. 1 and 2, in a lower part of the apparatus body 7, a cassette housing portion 29 is formed that is recessed along the horizontal direction. The cassette housing portion 29 is a recessed part that is open (not illustrated) in a side part of the apparatus body 7 and that extends from the edge of the opening into the apparatus body 7 in the horizontal direction. In an innermost part of the cassette housing portion 29 with respect to the horizontal direction, an opposing wall portion 32 is provided that stands vertically upright.

In the cassette housing portion 29, the sheet cassette 16 is housed. The sheet cassette 16 is inserted into the cassette housing portion 29 through the opening in the side part of the apparatus body 7. The sheet cassette 16 is removably mounted in the apparatus body 7; specifically, it can be pulled out of the apparatus body 7 from a position (mounted state) where it is inserted up to the innermost part of the cassette housing portion 29 with respect to the horizontal direction. In the following description, the direction in which the sheet cassette 16 is inserted into the cassette housing portion 29 to be mounted in the apparatus body 7 (i.e., the rightward direction along the horizontal direction in FIG. 2) will be referred to as the "mounting direction".

The sheet cassette 16 has a bottom portion 33, a pair of first side wall portions 34*a*, a second wall portion 34*b*, and a lift portion 35. The bottom portion 33 is a flat plate in a rectangular shape that extends in the horizontal direction, and constitutes a bottom part of the sheet cassette 16. On the bottom portion 33, sheets S1 are stacked (sheets as a recording medium, such as printing sheets, envelopes, and OHP sheets).

The pair of first side wall portions 34*a* are provided so as to connect to the opposite ends, respectively, of the bottom portion 33 in the sheet width direction (the direction perpendicular to the sheet conveyance direction, i.e., the direction perpendicular to the plane of FIG. 2). The second wall portion 34*b* connects to a downstream end part of the bottom portion 33 with respect to the mounting direction. The first and second side wall portions 34*a* and 34*b* stand upright in the vertical direction from the bottom portion 33. The first and second side wall portions 34*a* and 34*b* connect to each other so as to be orthogonal to each other. With the sheet cassette 16 mounted in the apparatus body 7, the second wall portion 34*b* faces the opposing wall portion 32 with respect to the mounting direction.

The lift portion 35 includes a support portion 36 and a stack plate 37. The support portion 36 is rotatably supported on the first side wall portions 34*a*. The stack plate 37 is a plate-form member on which sheets S1 can be stacked. The stack plate 37 is formed integrally with the support portion 36. As the support portion 36 rotates, the stack plate 37 ascends and descends relative to the bottom portion 33. The stack plate 37 is located downstream (rightward in FIG. 1) of the middle of the bottom portion 33 with respect to the sheet conveyance direction. As the stack plate 37 ascends and descends relative to the bottom portion 33, downstream end parts of the sheets S1 ascend and descend.

Downstream of the stack plate 37 with respect to the sheet conveyance direction, a pressing portion 53 is provided opposite a feed roller 42.

As shown in FIG. 1, in a side part of the apparatus body 7, above the opening of the cassette housing portion 29, an introduction port 38 is formed. Moreover, as shown in FIGS. 1 and 2, inside the apparatus body 7, between the cassette housing portion 29 and the intermediate transfer unit 31 with respect to the up-down direction, a feed passage 39 is formed. A bottom part of the feed passage 39 constitutes a top part of the cassette housing portion 29. The feed passage 39 communicates with the introduction port 38, and extends from the introduction port 38 to the sheet feed section 25. An opening in a downstream end part of the feed passage 39 in the sheet conveyance direction communicates, across the sheet feed section 25, with an upstream end part of the main conveyance passage 28.

The MPF tray 26 is fitted to a side part of the apparatus body 7, between the introduction port 38 and the opening edge of the cassette housing portion 29 with respect to the up-down direction. The MPF tray 26 is a tray that is inclined at a predetermined angle and on which sheets S2 can be stacked (sheets as a recording medium, such as printing sheets, envelopes, and OHP sheets).

The introduction port 38 is provided with a pair of introduction rollers 40. The pair of introduction rollers 40 makes contact with a downstream end part of a sheet S2 with respect to the sheet conveyance direction. The pair of introduction rollers 40, by rotating, introduces the sheet S2 into the feed passage 39. Along the feed passage 39, a plurality of pairs of conveyance rollers 47 are disposed at predetermined intervals with respect to the sheet conveyance direction. The pairs of conveyance rollers 47 are each a pair of rollers that face each other in the up-down direction across the feed passage 39 between them. The sheet S2 introduced into the feed passage 39 is conveyed by the pairs of conveyance rollers 47 toward the feed roller 42.

The sheet feed section 25 includes the opening 41 mentioned above and the feed roller 42. The space inside the cassette housing portion 29 communicates, via the opening 41, with the main conveyance passage 28. The dimension of the opening 41 in the sheet width direction is larger than the dimension of the sheet S1 or S2 in the width direction. That is, the sheet S1 or S2 can pass through the opening 41 in an open state.

The feed roller 42 is located at a position overlapping the opening 41 with respect to the sheet conveyance direction. The feed roller 42 is rotatably supported on the apparatus body 7, and rotates with a rotary driving force from an unillustrated driving device.

In the opposing wall portion 32, a housing recess portion 43 is formed that is recessed in the mounting direction. The assist plate 27 is housed inside the housing recess portion 43. The assist plate 27 is movable along the mounting direction between an assist position P1 (first position) and a retracted position P2 (second position). The assist position P1 is a position where the assist plate 27 protrudes out of the housing recess portion 43 to face the feed roller 42 (the position shown in FIG. 5). The retracted position P2 is a position where the assist plate 27 stays inside the housing recess portion 43 so as not to face the feed roller 42 (the position shown in FIG. 2).

The assist plate 27 includes a feed assist portion 44, a cassette contact portion 45, and a guide portion 46. The feed assist portion 44 is in a plate-form member that extends along the horizontal direction. With the assist plate 27 in the assist position P1, the feed assist portion 44 closes the opening 41 and faces the feed roller 42. In this state, the feed assist portion 44 and the feed roller 42 lie in contact with each other. With the assist plate 27 in the retracted position P2, the feed assist portion 44 leaves the opening 41 open.

The cassette contact portion 45 is a plate-form member that extends from an upstream end part of the feed assist portion 44 downward with respect to the mounting direction. With the sheet cassette 16 inserted in the cassette housing portion 29, the cassette contact portion 45 faces the second wall portion 34*b* in the mounting direction.

The guide portion 46 includes an insertion portion 48 and a restriction portion 49. The insertion portion 48 is a bar-shaped member that extends in the mounting direction from the face of the cassette contact portion 45 opposite from the sheet cassette 16. The restriction portion 49 is located in an end part of the insertion portion 48 in the mounting direction (an end part of it opposite from the cassette contact portion 45), and is formed so as to surround the outer circumference of the insertion portion 48. The maximum outer diameter of the restriction portion 49 is larger than the outer diameter of the insertion portion 48.

The housing recess portion 43 includes a first recess portion 50 and a second recess portion 51. In the first recess portion 50, the feed assist portion 44 of the assist plate 27 is housed. In the second recess portion 51, the guide portion 46 is housed. The second recess portion 51 is a cylindrical bore. On the inner circumferential face of the second recess portion 51, a restricting projection 52 is provided that projects in the radial direction.

At the position of the restricting projection 52 with respect to the mounting direction, the inner diameter of the second recess portion 51 is smaller than the outer diameter of the restriction portion 49. Elsewhere than at the position of the restricting projection 52, the inner diameter of the second recess portion 51 is larger than the outer diameter of the restriction portion 49. Thus, when the assist plate 27 moves from the retracted position P2 to the assist position P1, the restriction portion 49 makes contact with the restricting projection 52, and the assist plate 27 is restrained from moving in the direction (leftward direction in FIG. 2) opposite to the mounting direction.

The urging member 54 is a coil spring that is fitted around the insertion portion 48. The urging member 54 is disposed in the second recess portion 51. The urging member 54 makes contact with the cassette contact portion 45 and the restricting projection 52 with respect to the mounting direction. The urging member 54 presses the cassette contact portion 45 in the direction opposite to the mounting direction, and urges the assist plate 27 toward the assist position P1 (the position shown in FIG. 5).

Figure 3:
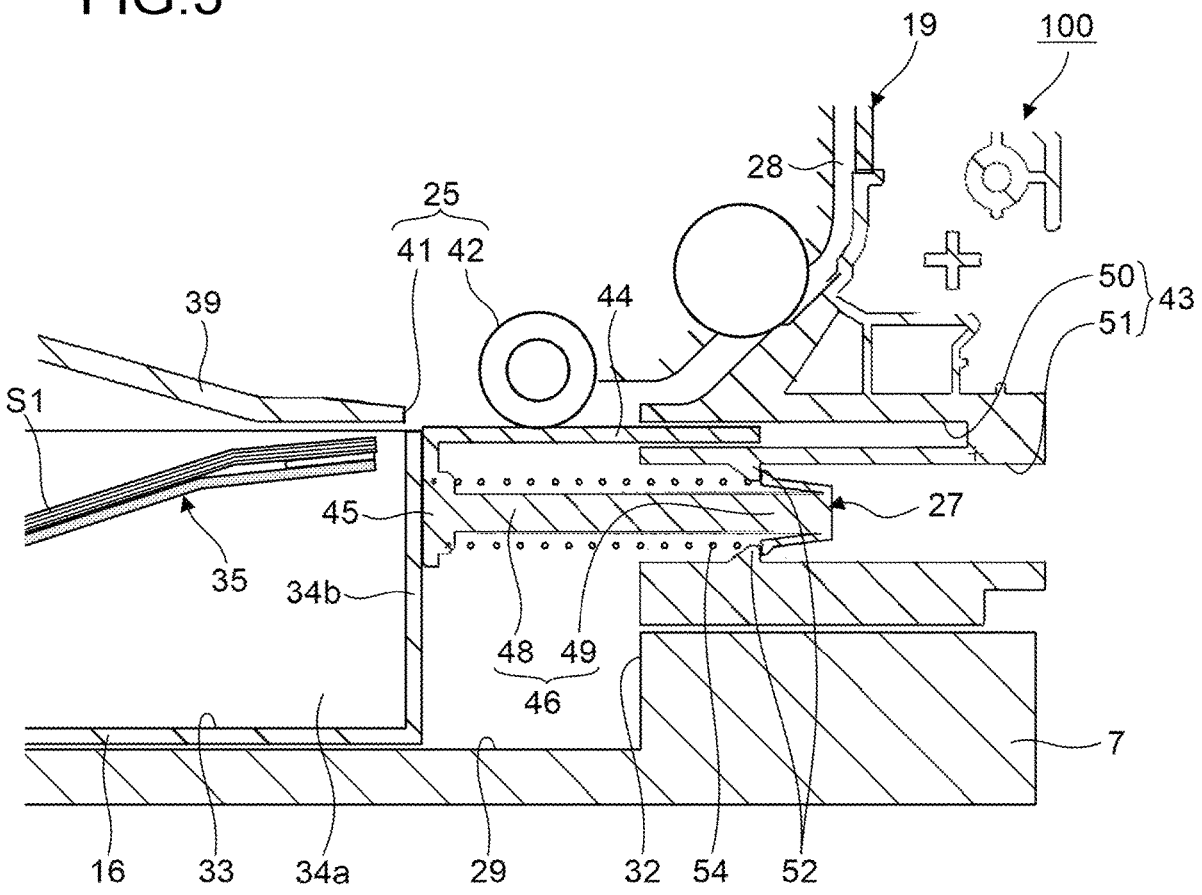
FIG. 3 is a side sectional view showing a state where a sheet cassette lies in contact with a cassette contact portion of an assist plate.

FIG. 3 is a side sectional view showing a state where the sheet cassette 16 lies in contact with the cassette contact portion 45 of the assist plate 27. As shown in FIG. 3, when the sheet cassette 16 is inserted in the cassette housing portion 29 until it reaches a predetermined position, the second wall portion 34*b* and the cassette contact portion 45 make contact with each other. In this state, moving the sheet cassette 16 deeper in the cassette housing portion 29 (rightward in FIG. 3) causes the cassette contact portion 45 to be pressed by the second wall portion 34*b* so that the assist plate 27 moves, along with the sheet cassette 16, toward the retracted position P2 (the position shown in FIG. 2) against the urging force of the urging member 54.

As the sheet cassette 16 moves from the position in FIG. 3 in the direction opposite to the mounting direction inside the cassette housing portion 29, the assist plate 27 moves toward the assist position P1 under the urging force of the urging member 54. When the assist plate 27 reaches the assist position P1, as described above, the restriction portion 49 makes contact with the restricting projection 52 to restrain the movement of the assist plate 27.

Next, the feeding of a sheet S1 will be described. As shown in FIG. 2, a sheet S1 is fed from the sheet cassette 16 mounted in the apparatus body 7. More specifically, first, with the sheet cassette 16 mounted in the apparatus body 7, the pressing portion 53 is located at a position overlapping the opening 41 with respect to the sheet conveyance direction.

In this state, as described above, the assist plate 27 is in the retracted position P2 and leaves the opening 41 open. With the sheet cassette 16 mounted in the apparatus body 7, the lift portion 35 lifts a downstream end part of the sheet S1 and presses it against the outer circumferential surface of the feed roller 42 through the opening 41. At this time, the downstream end part of the sheet S1 is pinched between the feed roller 42 and the pressing portion 53.

In this state, with the sheet cassette 16 mounted in the apparatus body 7, the feed roller 42 is rotated. Then, as the feed roller 42 rotates, of the sheets S1 placed in a bundle in the sheet cassette 16, the topmost sheet S1 is fed to the main conveyance passage 28.

Figure 4:
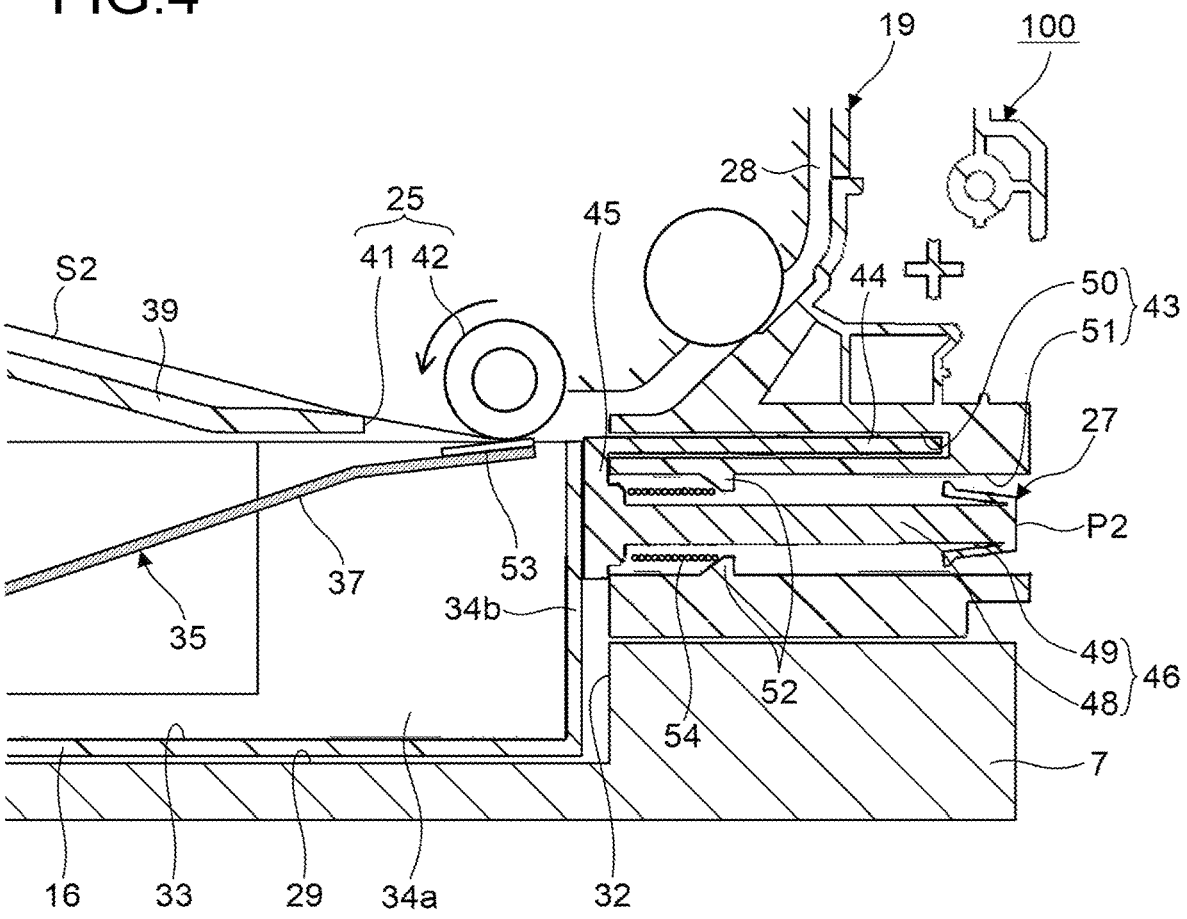
FIG. 4 is a side sectional view of the image forming apparatus in a state where, with the sheet cassette mounted in the apparatus body, a sheet has been fed from an MPF tray.

Next, the feeding of a sheet S2 from the MPF tray 26 will be described, first for a case where the sheet cassette 16 is mounted in the apparatus body 7 and then for a case where the sheet cassette 16 is removed from the apparatus body 7. FIG. 4 is a side sectional view of the image forming apparatus 100 in a state where, with the sheet cassette 16 mounted in the apparatus body 7, a sheet S2 has been fed from the MPF tray 26.

As shown in FIG. 4, when in this state the sheet S2 is conveyed through the feed passage 39 up to the sheet feed section 25, while the sheet S2 is passing over the pressing portion 53, a downstream part of it is lifted by the lift portion 35 to be brought into pressed contact with the feed roller 42. In this state, as the feed roller 42 rotates, the sheet S2 is fed to the main conveyance passage 28. While sheets S1 are omitted from illustration in FIG. 4, also in a case where sheets S1 are stacked on the lift portion 35, the lift portion 35 keeps the sheet S2 in pressed contact with the feed roller 42 via the sheets S1.

Figure 5:
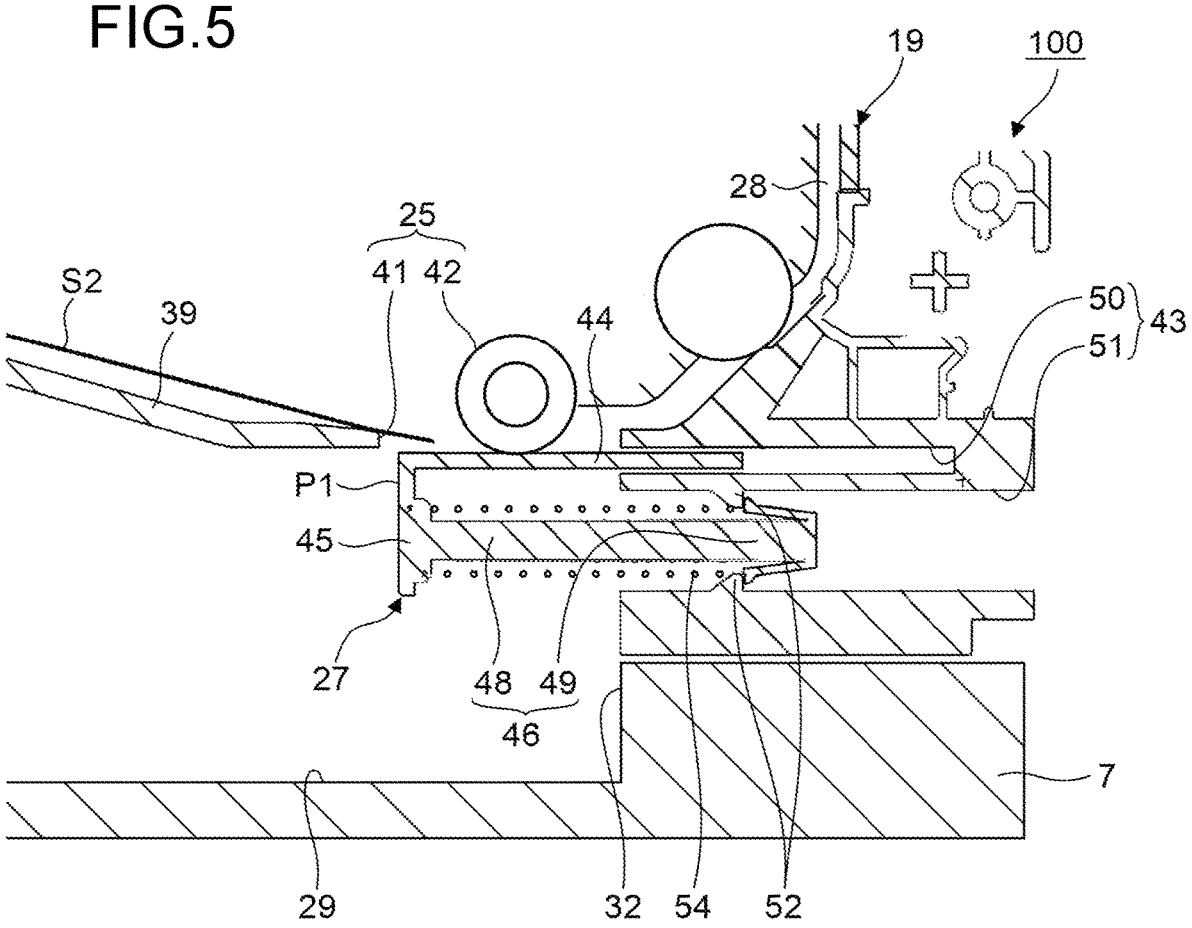
FIG. 5 is a side sectional view of the image forming apparatus in a state where, with the sheet cassette removed from the apparatus body, a sheet has been fed from the MPF tray.

FIG. 5 is a side sectional view of the image forming apparatus 100 in a state where, with the sheet cassette 16 removed from the apparatus body 7, a sheet S2 has been fed from the MPF tray 26.

As shown in FIG. 5, in this state, as described above, the assist plate 27 keeps the opening 41 closed, and the feed assist portion 44 lies in pressed contact with the feed roller 42. In this state, when the sheet S2 is conveyed up to the sheet feed section 25, the sheet S2 is brought into pressed contact with the feed roller 42 by the feed assist portion 44. Thus, as the feed roller 42 rotates, the sheet S2 is fed to the main conveyance passage 28.

As described above, with the sheet cassette 16 mounted in the apparatus body 7, the lift portion 35 brings downstream end parts of sheets S1 an S2 into pressed contact with the feed roller 42. With the sheet cassette 16 removed from the apparatus body 7, the assist plate 27 brings a downstream end part of a sheet S2 into pressed contact with the feed roller 42. Thus, regardless of whether the sheet cassette 16 is mounted in or removed from the apparatus body 7, a sheet S2 can be fed from the MPF tray 26 to the main conveyance passage 28. It is thus possible to provide a sheet conveyance device 19 that can feed a sheet S2 from the MPF tray 26 to the main conveyance passage 28 with the sheet cassette 16 removed from the apparatus body 7, and to provide an image forming apparatus 100 provided with such a sheet conveyance device. This image forming apparatus 100 allows hand-feed printing even with the sheet cassette 16 removed.

Moreover, as described above, when the sheet cassette 16 is inserted completely into the cassette housing portion 29, the assist plate 27 is pressed by the second wall portion 34*b* to move from the assist position P1 toward the retracted position P2. By contrast, when the sheet cassette 16 is pulled out of the cassette housing portion 29, the assist plate 27 moves from the retracted position P2 to the assist position P1 under the urging force of the urging member 54. Thus, the movement of the assist plate 27 does not require electrical control or a moving mechanism, and this contributes to a comparatively simple construction. This helps suppress an increase in the manufacturing cost of the sheet conveyance device 19. Also for the user of the image forming apparatus 100, the assist plate 27 that moves automatically as the sheet cassette 16 is mounted in and removed from the apparatus body 7 eliminates the need for special operation. This helps avoid degrading the operability of the image forming apparatus 100.

Figure 6:
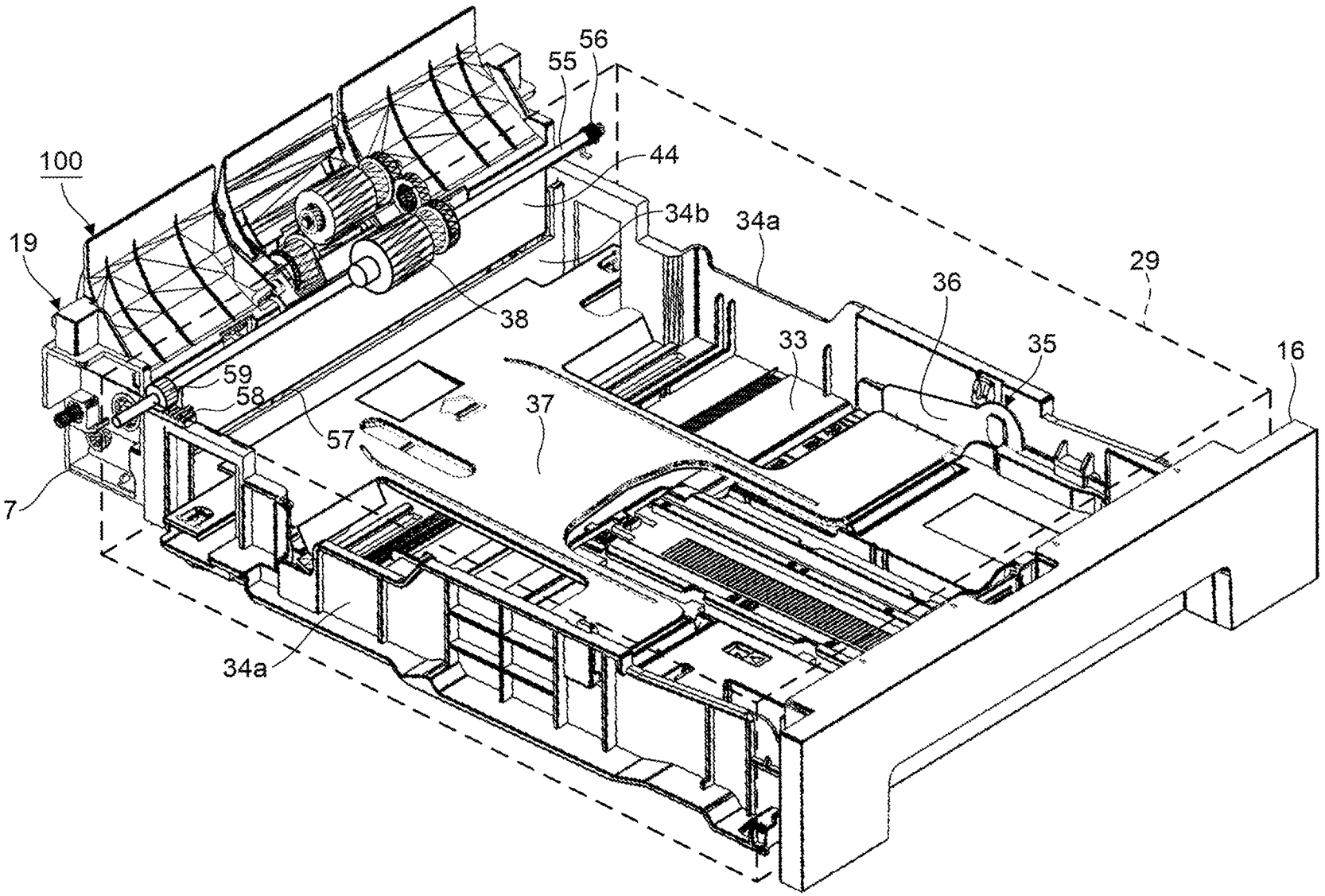
FIG. 6 is a perspective view around a cassette housing portion in a sheet conveyance device according to a second embodiment.
Figure 7:
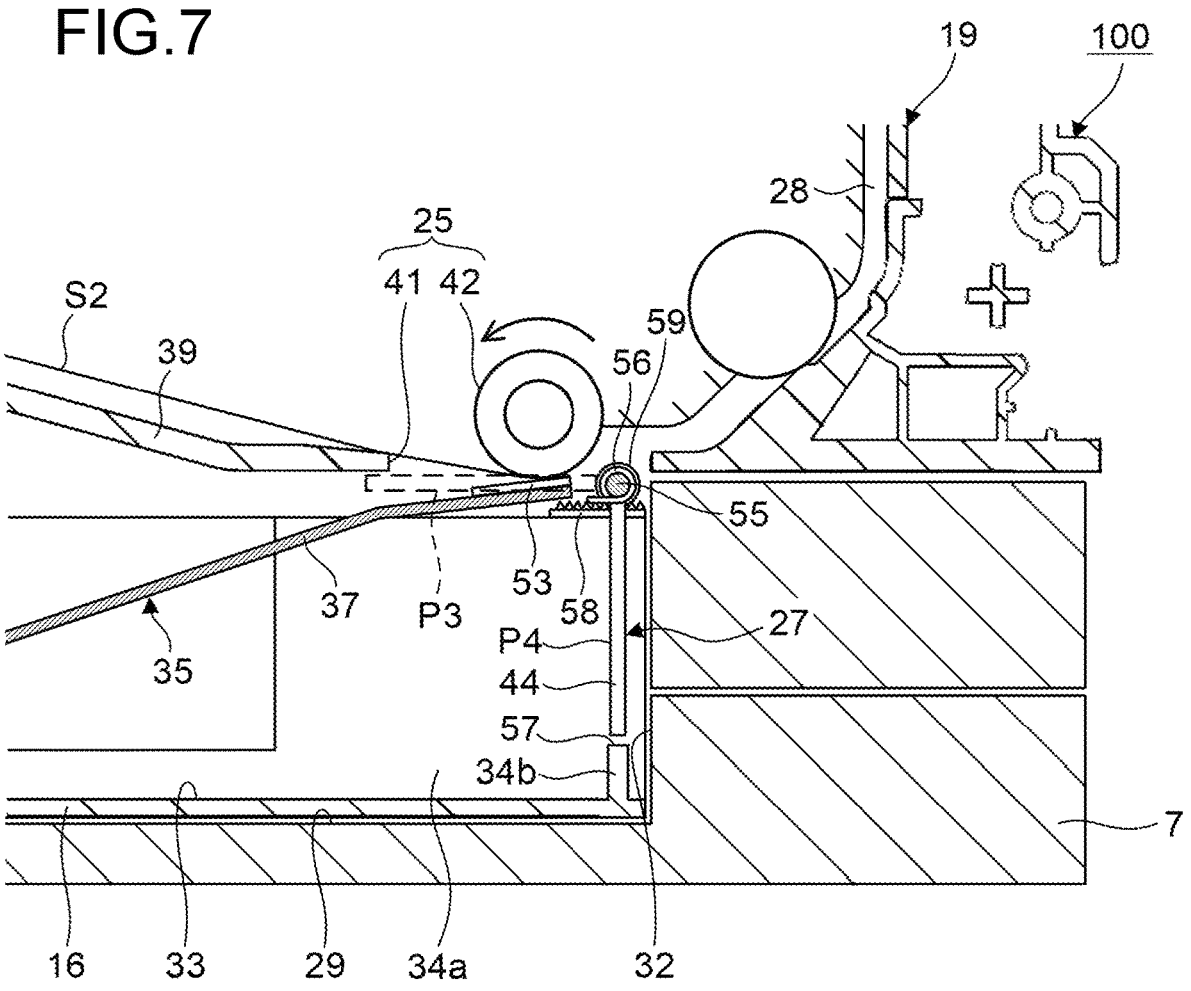
FIG. 7 is a side sectional view of the sheet conveyance device according to the second embodiment.

Next, a description will be given of a sheet conveyance device 19 according to a second embodiment and an image forming apparatus 100 provided with it. The following description focuses on differences from the first embodiment; for such features as are similar to those of the first embodiment, the same reference signs are adhered to and no overlapping description will be repeated. FIG. 6 is a perspective view around a cassette housing portion 29 in the sheet conveyance device 19 according to this embodiment. FIG. 7 is a side sectional view of the sheet conveyance device 19 according to this embodiment.

As shown in FIGS. 6 and 7, the sheet conveyance device 19 according to this embodiment includes an assist plate 27 that includes a rotary shaft 55 and a feed assist portion 44. The rotary shaft 55 is a shaft member that connects to the feed assist portion 44 and that extends parallel to the sheet width direction. The rotary shaft 55 is rotatably supported on the apparatus body 7 at a position above an upper end part of the first side wall portions 34*a*.

The assist plate 27 is rotatable in the circumferential direction of the rotary shaft 55 between an assist position P3 in which the feed assist portion 44 faces the feed roller 42 and a retracted position P4 in which the feed assist portion 44 is retracted from the feed roller 42. With the assist plate 27 in the retracted position P4, the feed assist portion 44 faces the opposing wall portion 32 in the mounting direction.

Near an end part of the rotary shaft 55 at one side in its axial direction (at the side opposite from a first engagement portion 58, which will be described later), an urging member 56 is coupled to it. The urging member 56 is what is called a torsion coil spring. The urging member 56 is fitted around the rotary shaft 55. The urging member 56 urges the assist plate 27 from the retracted position P4 toward the assist position P3 along the circumferential direction of the rotary shaft 55.

In the second wall portion 34*b*, a retraction recess portion 57 is formed. The retraction recess portion 57 is recessed from the top end of the second wall portion 34*b* toward the bottom portion 33. With the assist plate 27 in the retracted position P4, the feed assist portion 44 is located inside the retraction recess portion 57.

The sheet conveyance device 19 includes a first engagement portion 58 and a second engagement portion 59. The first and second engagement portions 58 and 59 are a rack-and-pinion composed of a rack gear and a pinion gear. The first engagement portion 58 is a rack gear. The first engagement portion 58 is formed at the top end of a first side wall portion 34*a* so as to extend along the mounting direction. The second engagement portion 59 is a pinion gear that can engage with the first engagement portion 58. The second engagement portion 59 is coupled with the rotary shaft 55 so as to rotate together with the rotary shaft 55.

Figure 8:
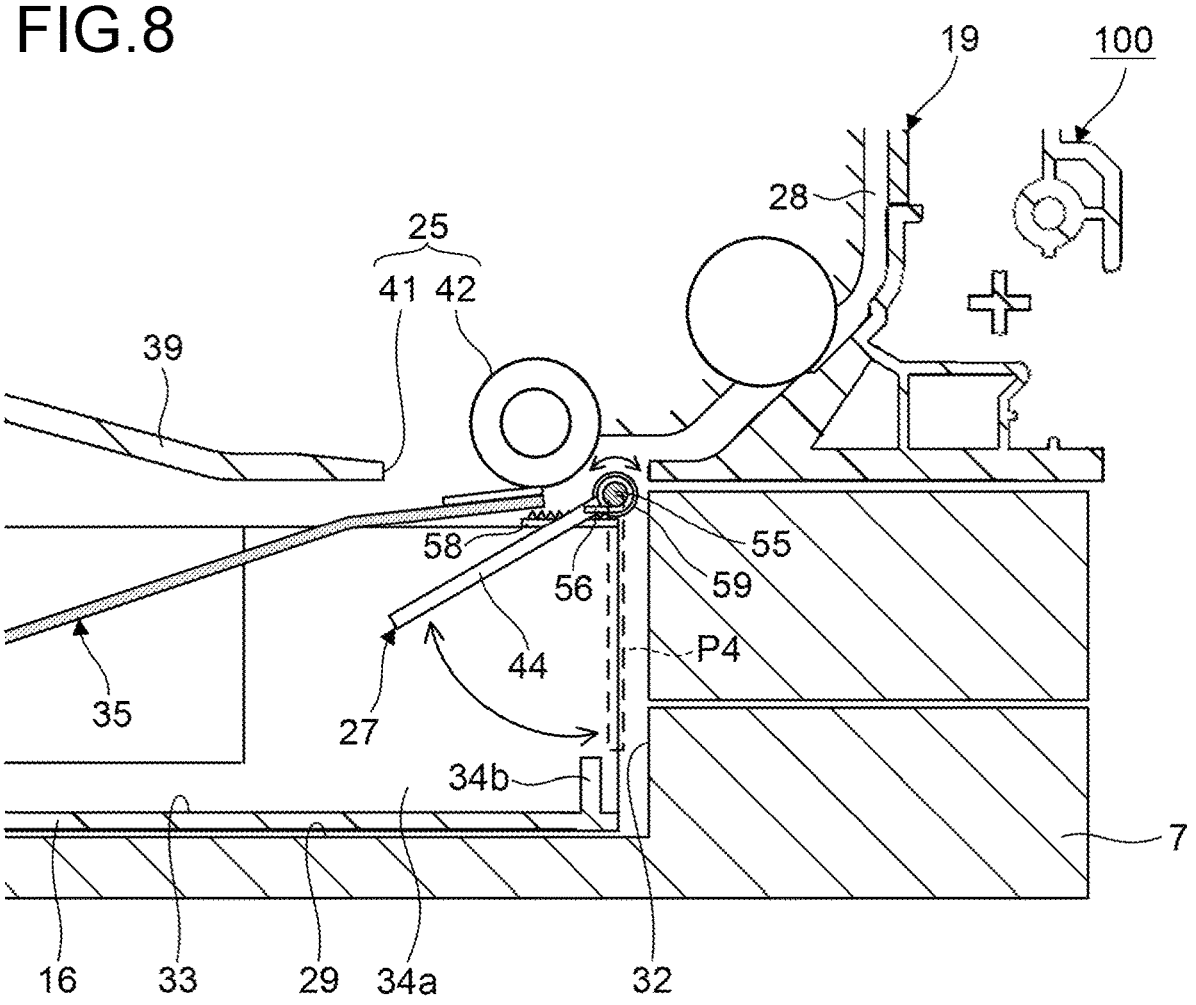
FIG. 8 is a side sectional view of the sheet conveyance device in a state where a sheet tray has been inserted up to a predetermined position in a tray housing portion.

The second engagement portion 59 is located at a position overlapping the first engagement portion 58 with respect to the sheet width direction. As shown in FIG. 8, with the sheet cassette 16 inserted in the cassette housing portion 29 and at a predetermined position with respect to the mounting direction, the first and second engagement portions 58 and 59 are in mesh with each other and are in an engaged state.

With the first and second engagement portions 58 and 59 in the engaged state, when the sheet cassette 16 moves along the mounting direction, following the movement of the first engagement portion 58 in the mounting direction, the second engagement portion 59 rotates. As the second engagement portion 59 rotates, the assist plate 27 rotates between the assist position P3 and the retracted position P4.

More specifically, when in this state the sheet cassette 16 is moved in the mounting direction, the assist plate 27 rotates toward the retracted position P4 against the urging force of the retraction recess portion 57; when the sheet cassette 16 is moved in the direction opposite to the mounting direction, the assist plate 27 rotates toward the assist position P3 under the urging force of the urging member 56. When the assist plate 27 reaches the assist position P3, the first engagement portion 58 moves away from the second engagement portion 59. With the sheet cassette 16 inserted up to the innermost part of the cassette housing portion 29 and mounted in the apparatus body 7, the assist plate 27 is located in the retracted position P4.

As shown in FIG. 7, when with the sheet cassette 16 mounted in the apparatus body 7 a sheet S2 is conveyed from the MPF tray 26 to the sheet feed section 25, a downstream end part of the sheet S2 is brought into pressed contact with the feed roller 42 by the lift portion 35. In this state, as the feed roller 42 rotates, the sheet S2 is fed to the main conveyance passage 28.

Figure 9:
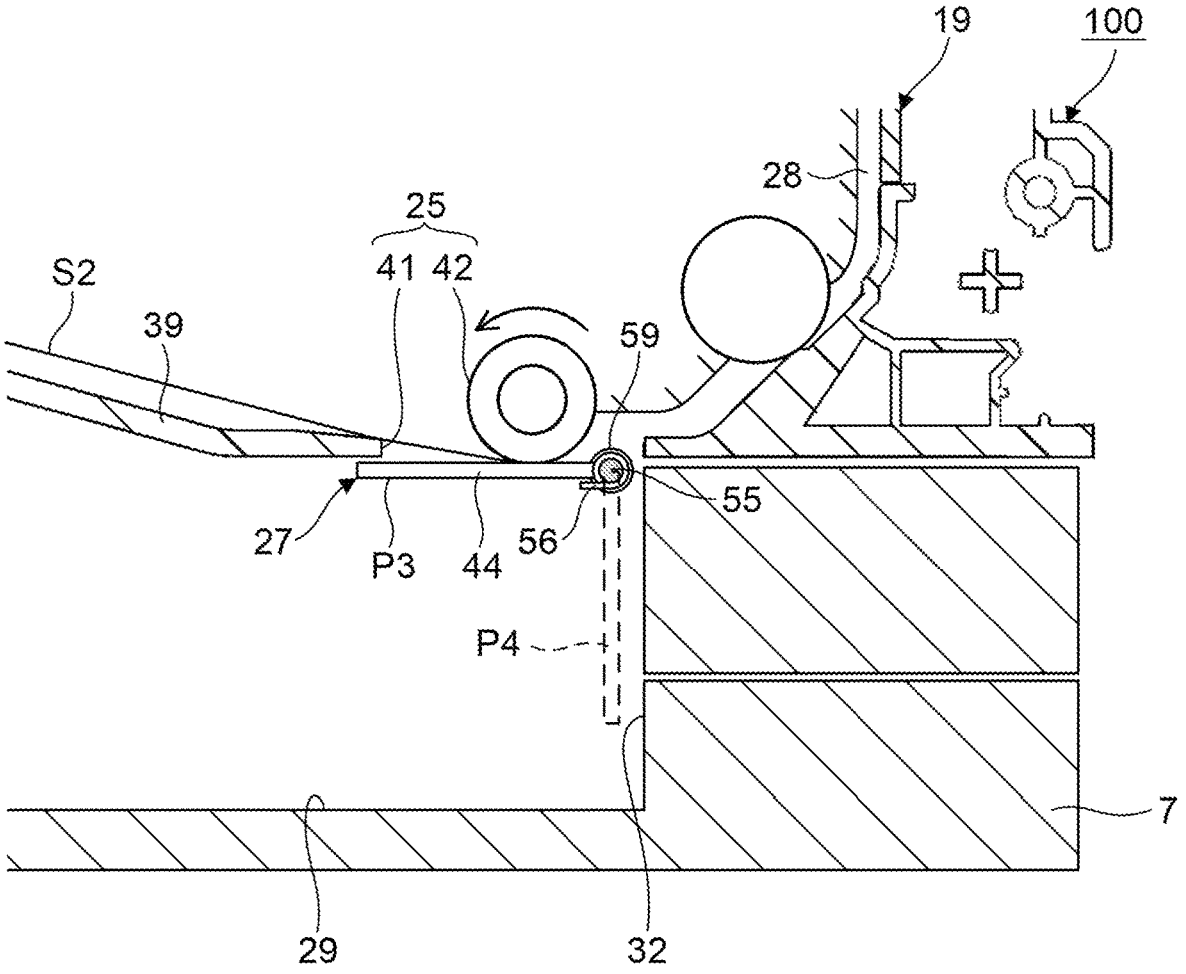
FIG. 9 is a side sectional view of the sheet conveyance device in a state where the sheet tray has been pulled out of the tray housing portion.

As shown in FIG. 9, when with the sheet cassette 16 removed from the apparatus body 7 a sheet S2 is conveyed from the MPF tray 26 to the sheet feed section 25, a downstream end part of the sheet S2 is brought into pressed contact with the feed roller 42 by the feed assist portion 44. In this state, as the feed roller 42 rotates, the sheet S2 is fed to the main conveyance passage 28.

Also on the sheet conveyance device 19 according to this embodiment, as in the first embodiment, with the sheet cassette 16 mounted in the apparatus body 7, the lift portion 35 brings downstream-side end parts of sheets S1 and S2 into pressed contact with the feed roller 42. By contrast, with the sheet cassette 16 removed from the apparatus body 7, the assist plate 27 brings a downstream end part of a sheet S2 into pressed contact with the feed roller 42. It is thus possible to provide an image forming apparatus 100 that allows hand-feed printing with the sheet cassette 16 removed.

Moreover, when the assist plate 27 is in the retracted position P4, the feed assist portion 44 is located inside the retraction recess portion 57. This eliminates the need to separately secure a space in the apparatus body 7 to house the assist plate 27 in, and helps reduce the size of the sheet conveyance device 19.

Moreover, the urging member 54 urges the assist plate 27 toward the assist position P3 along the circumferential direction of the rotary shaft 55. This permits the assist plate 27 to be pressed toward the feed roller 42. The sheet S2 fed from the MPF tray 26 is then more appropriately pressed against the feed roller 42. It is thus possible to avoid feed failure of the sheet S2.

Moreover, as described above, the first and second engagement portions 58 and 59 mesh with each other, and this permits the rotary shaft 55 to rotate as the sheet cassette 16 moves. Thus, when the sheet cassette 16 is pulled out of the cassette housing portion 29, the assist plate 27 moves to the assist position P3 without depending solely on the urging force of the urging member 54. Thus, the assist plate 27 appropriately moves to the assist position P3, and this helps avoid feed failure of the sheet S2.

The embodiments described above are not meant to limit the scope of the present disclosure, which thus allows for any modifications without departure from the spirit of what is disclosed herein. For example, while in the sheet conveyance device 19 according to the second embodiment the first and second engagement portions 58 and 59 are a rack-and-pinion composed of one rack gear and one pinion gear, this is not meant as any limitation. Instead, for example, at least one of the first and second engagement portions 58 and 59 may be configured as a gear train composed of a plurality of gears that can transmit a rotary force to the rotary shaft 55 such that it follows the movement of the sheet cassette 16.

The present disclosure is applicable not only to tandem-type color printers like the one shown in FIG. 1 but also to various image forming apparatuses of an intermediate transfer type that have an image forming section disposed above an intermediate belt.

A sheet conveyance device like the one 19 described above can be mounted in the body of not only an image forming apparatus but also an apparatus provided with at least two sheet stack sections as sheet feed sources (such as a large-capacity sheet storage apparatus that is arranged upstream of an image forming apparatus and that can feed sheets to the image forming apparatus).

The present disclosure finds applications in apparatuses (such as image forming apparatuses and sheet storage apparatuses) that are provided with at least two sheet stack sections as sheet feed sources. According to the present disclosure, it is possible to perform printing even with one sheet stack section removed from the apparatus body by feeding sheets from another sheet stack section.

What is claimed is:

1. A sheet conveyance device comprising:

a sheet conveyance passage provided in an apparatus body, the sheet conveyance passage conveying a sheet;

a first sheet stack section having:

a bottom portion on which the sheet is stacked; and a lift portion provided so as to be ascendible-descendible relative to the bottom portion, the lift portion raising and lowering a downstream end part, in a sheet conveyance direction, of the sheet on the bottom portion, the first sheet stack section removably mounted in the apparatus body, a second sheet stack section on which the sheet conveyed along the sheet conveyance passage is stacked;

a sheet feed section having:

an opening formed in the sheet conveyance passage, the opening permitting the sheet stacked on the first sheet stack section to pass therethrough; and a feed roller disposed at a position overlapping the opening with respect to the sheet conveyance direction, with the first sheet stack section mounted in the apparatus body, the lift portion pressing the sheet against the feed roller via the opening, the sheet feed section feeding the sheet pinched between the lift portion and the feed roller along the sheet conveyance passage, wherein the sheet conveyance device further includes:

an assist plate supported so as to be movable between a first position in which the assist plate overlaps the opening with respect to the sheet conveyance direction to face the feed roller and a second position in which the assist plate is located away from the opening; and an urging member that urges the assist plate from the second position toward the first position, with the first sheet stack section mounted in the apparatus body, the assist plate moves from the first position to the second position against an urging force of the urging member to allow the sheet to pass from the first sheet stack section to the sheet feed section, and with the first sheet stack section removed from the apparatus body, the assist plate is urged by the urging member to move from the second position to the first position to support the sheet conveyed from the second sheet stack section to the sheet feed section.

2. The sheet conveyance device according to claim 1, wherein the first sheet stack section has:

the bottom portion extending along a mounting direction in which the first sheet stack section is mounted into the apparatus body; and a side wall portion standing substantially vertically upright from a downstream end part of the bottom portion with respect to the mounting direction, the apparatus body has:

an opposing wall portion facing, in the mounting direction, the side wall portion of the sheet stack section mounted in the apparatus body; and a housing recess portion recessed from the opposing wall portion in the mounting direction, the housing recess portion permitting the assist plate to be housed therein, with the first sheet stack section mounted in the apparatus body, the assist plate is pressed by the side wall portion to be located in the second position in which, against the urging force of the urging member, the assist plate is housed in the housing recess portion, and with the first sheet stack section removed from the apparatus body, the assist plate is located in the first position by protruding from the opposing wall portion under the urging force of the urging member.

3. The sheet conveyance device according to claim 1, further comprising:

a first engagement portion provided on the first sheet stack section; and a second engagement portion provided on the assist plate, the second engagement portion being engageable with the first engagement portion, wherein the second engagement portion engages with the first engagement portion when the first sheet stack section is located between a mounted position in which the first sheet stack section is mounted in the apparatus body and an apart position in which, with the first sheet stack section having moved in a direction opposite to a mounting direction in which the first sheet stack section is mounted into the apparatus body, the lift portion is located away from the feed roller, and with the first and second engagement portions engaged with each other, the assist plate moves between the second and first positions by following movement of the first sheet stack section between the mounted position and the apart position.

4. The sheet conveyance device according to claim 3, wherein the assist plate has a rotary shaft that extends in a direction orthogonal to the mounting direction and that is rotatably supported on the apparatus body, the first engagement portion is a rack gear that extends in the mounting direction, the second engagement portion is a pinion gear that is provided on the rotary shaft and that meshes with the rack gear, and the urging member is a torsion spring that urges the assist plate in a direction opposite to a direction in which the pinion gear rotates when the first sheet stack section moves to the mounted position.

5. An image forming apparatus comprising:

an image forming section that forms an image on the sheet; and the sheet conveyance device according to claim 1 that conveys the sheet to the image forming section.

* * * * *